US009392658B2

(12) United States Patent
Chowdhury et al.

(10) Patent No.: US 9,392,658 B2
(45) Date of Patent: Jul. 12, 2016

(54) SKIP-PHASE WIRELESS DIMMER FOR SOLID-STATE LIGHTING

(71) Applicant: Juno Manufacturing, LLC, Des Plaines, IL (US)

(72) Inventors: Towfiq Chowdhury, Des Plaines, IL (US); Bobby D. Taylor, Des Plaines, IL (US)

(73) Assignee: Acuity Brands Lighting, Inc., Atlanta, GA (US)

( * ) Notice: Subject to any disclaimer, the term of this patent is extended or adjusted under 35 U.S.C. 154(b) by 0 days.

(21) Appl. No.: 14/565,231

(22) Filed: Dec. 9, 2014

(65) Prior Publication Data

US 2016/0165693 A1 Jun. 9, 2016

(51) Int. Cl.

| | |
|---|---|
| ***H05B 41/16*** | (2006.01) |
| ***H05B 41/24*** | (2006.01) |
| ***H05B 33/08*** | (2006.01) |
| ***H05B 37/02*** | (2006.01) |

(52) U.S. Cl.
CPC ..... *H05B 33/0845* (2013.01); *H05B 33/0887* (2013.01); *H05B 37/0272* (2013.01)

(58) Field of Classification Search
None
See application file for complete search history.

(56) References Cited

U.S. PATENT DOCUMENTS

| | | | | |
|---|---|---|---|---|
| 8,222,832 | B2 | 7/2012 | Zheng et al. | |
| 8,536,799 | B1 * | 9/2013 | Grisamore et al. | 315/294 |
| 2011/0181196 | A1 * | 7/2011 | Kang et al. | 315/246 |
| 2013/0175931 | A1 | 7/2013 | Sadwick | |

OTHER PUBLICATIONS

CLW-DELVEX-277-P, Cameo® Wireless In-Wall ELV Dimmer, 277V Product Specification, Crestron Electronics, Inc., 2016, 2 pages.
Control4® Wireless Adaptive Phase Dimmer, Control4 Corporation Product Specification, 2013, 3 pages.
"State-of-the-Art Dimming for Dummies: Part One," from *Architectural Lighting*, Jun. 2006, *http://www.archlighting.com/acoustics/state-of-the-art-dimming-for-dummies--part-one.aspx*, posted on Mar. 8, 2007, 4 pages.
RadioRA® 2 Maestro® Local Controls Product Specification, RadioRA® 2, Jan. 15, 2015, 14 pages.
(Continued)

*Primary Examiner* — Anh Tran
(74) *Attorney, Agent, or Firm* — Kilpatrick Townsend & Stockton LLP

(57) ABSTRACT

System and method for dimming solid-state lighting (SSL) avoids visual anomalies such as flicker for different types of SSL fixtures. This ability to avoid visual anomalies allows the system and method to be compatible with virtually any SSL fixture from any manufacturer. A controller is provided in some implementations that automatically generates a dimming voltage for the SSL fixtures based on a dimming control signal. A skip-phase dimming module is provided in some implementations that operates in conjunction with the controller to automatically skip dimming levels that cause visual anomalies in the SSL fixtures. A wireless module is provided in some implementations to receive signals from remote sensors and other input devices, such as ambient light sensors, occupancy sensors, color sensors, and the like.

22 Claims, 13 Drawing Sheets

(56) References Cited

OTHER PUBLICATIONS

WiFi Touch Panel Dimmer, Model No. TM111 Product Specification, ShenZhen Leynew Technology Co., Ltd., *http://www.leynew.lightstrade.com/view/144125/WiFi-Touch-Panel-Dimmer.html*, retrieved Jan. 2016, 2 pages.

WiFi Touch Panel Dimmer, Model TM111 Product Specification, Shenzhen Starwell Technology Co., LTD., *http://starwell.cc/product.asp/id=398*, retrieved Jan. 21, 2016, 7 pages.

* cited by examiner

SKIP-PHASE WIRELESS DIMMER FOR SOLID-STATE LIGHTING

FIELD OF THE INVENTION

The disclosed embodiments relate generally to methods and systems for providing dimming control of solid-state lighting (SSL) devices, such as light emitting diodes (LEDs), and more particularly to a method and system for providing dimming control of SSL devices that selectively avoids and/or removes flicker modes.

BACKGROUND OF THE INVENTION

LEDs have the potential to revolutionize the efficiency, appearance, and quality of lighting. According to the United States Department of Energy, about 49 million LEDs were installed in the United States in 2012, saving about $675 million in annual energy costs. Switching entirely to LED lights over the next two decades could save the U.S. $250 billion in energy costs, reduce electricity consumption for lighting by nearly 50 percent, and avoid 1,800 million metric tons of carbon emissions. See http://energy.gov/articles/top-8-things-you-didn-t-know-about-leds.

Switching over to LED lighting, however, is not without challenges. LED lighting requires DC current to flow through the LEDs and, as such, the LEDs cannot simply be dropped in as replacements for incandescent lights, which use AC voltage. For the same reason, LEDs cannot be connected directly to dimmers that were designed for incandescent lights, as such dimmers control lighting by adjusting the RMS (root mean square) value of the AC voltage supplied to the incandescent lights. These dimmers use a technique called "phase cut" that suppresses a portion of the AC voltage to reduce the RMS value of the AC voltage.

There are generally two types of phase cut dimmers: forward phase cut (leading edge) dimmers, and reverse phase cut (trailing edge) dimmers. In a forward phase cut dimmer, the AC voltage from the line AC is cut or chopped at the front end of each half wave. In a reverse cut dimmer, the AC voltage from the line AC is cut or chopped at the back end of each half wave. In either case, the remaining uncut phase of the AC voltage results in a reduced RMS value. And because the phase cuts are typically made in predefined time intervals or increments that are usually too small for the human eye to discern, the dimming appears smooth and flicker-free.

But as both forward phase cut and reverse phase cut dimmer types are still AC voltage devices, neither dimmer type is suitable for LED lighting without significant modifications. Most LEDs and other SSL applications therefore have a fixture that includes a driver for driving the SSL. The SSL driver typically includes a power converter such as a switch mode power supply that converts AC line voltage to DC current to drive the SSL. The power converter typically has an AC/DC constant voltage converter that takes the AC line voltage and outputs a relatively constant DC voltage. A DC/DC constant current converter then converts the DC voltage to a relatively constant DC current to drive the SSL. Such an arrangement conceptually allows SSL fixtures to be used with phase cut dimmers available for incandescent lights.

In practice, however, a problem may sometimes arise with flicker and other visual anomalies when using existing phase cut dimmers with SSL fixtures. Flicker and other visual anomalies can be seen when there are sufficiently large ripples in the DC current provided to the SSL. The ripples result from an incompatible interaction between the phase cut dimmer and the switch mode power supplies and/or other elements of the SSL fixture. The problem often arises when a phase cut dimmer from one manufacturer is being used with an SSL fixture from a different manufacturer. This lack of compatibility has required dimmer manufacturers to list on their product literature and packaging which dimmers are compatible with which SSL fixtures, and vice versa.

Moreover, existing dimmers are largely non-interactive, consisting mainly of wall-mounted sliding switches, knobs, pads, and dials that have to be manually adjusted by a user each time the user wants to adjust room lighting. And while some programmable dimmers exist that can adjust lighting automatically in response to ambient light sensors and other inputs, these dimmers have heretofore been wired systems that require the sensors and other inputs to be transmitted over cables or wiring. In order to use a wireless sensor with such dimmers, a centralized coordinator device typically is needed to receive the signals from the wireless sensor and transmit them to the dimmer, which adds costs and complexity.

Thus, a need exists for an improved way to provide dimming for SSL fixtures, and particularly for a dimmer that is interactive, wireless, and capable of avoiding flicker and other visual anomalies for different types of SSL fixtures from various manufacturers.

SUMMARY OF THE DISCLOSED EMBODIMENTS

The disclosed embodiments are directed to systems and methods for controlling dimming. The embodiments provide a dimmer that is interactive, wireless, and capable of automatically avoiding visual anomalies such as flicker resulting from incompatibilities between the dimmer and switch mode power supplies and/or other elements of the SSL fixtures. The dimmer supports or may employ any dimming technique known to those having ordinary skill in the art, including forward phase cut, reverse phase cut, 1-10 V DC dimming, as well as adaptive phase dimming that can sense fixture load types and automatically adjust to provide the best performance. The ability automatically to avoid visual anomalies such as flicker allows the dimmer to be used with virtually any SSL lighting fixture from any manufacturer.

In some implementations, the dimmer also includes a built-in wireless module that allows the dimmer to receive signals remotely from sensors and other input devices. The sensors and other input devices may include, for example, ambient light sensors, occupancy sensors, color sensors, and the like. A controller such as a microcontroller within the dimmer may be programmed automatically to adjust or dim room lighting based on the inputs from these sensors.

In some implementations, the dimmer further includes a skip-phase dimming module that can automatically skip dimming levels that cause visual anomalies such as flicker in the SSL fixtures. The skip-phase dimming module may reside in firmware, software, or a combination of both, and operates in conjunction with the controller to monitor a feedback signal from the SSL fixtures and identify dimming levels that cause visual anomalies such as flicker. These dimming levels may be found, for example, by detecting anomalies such as ripples on the feedback signal that are larger than a preset threshold. Once an anomalous dimming level is found, the skip-phase dimming module designates the phase angle corresponding to that dimming level as an anomalous phase angle. The anomalous phase angle may then be stored as a known or identified anomalous phase angle along with other identified anomalous phase angles for that SSL fixture. Subsequent dimming levels having phase angles that match an identified anomalous phase angle may then be skipped by the controller in favor of the next or previous incremental dimming level, depending on dimming direction, that does not correspond to an identified anomalous phase angle.

In some implementations, the skip-phase dimming module may include a predefined list of SSL fixture types, for example, by model and/or manufacturer, along with previously known or identified anomalous phase angles for each fixture type. This information may be stored or otherwise incorporated into the skip-phase dimming module, for example, during manufacture of the dimmer. Then, when a user installs the dimmer, he or she may select the specific SSL fixture being used with the dimmer to retrieve the previously identified anomalous phase angles for that SSL fixture. As well, the skip-phase dimming module may automatically learn and accumulate additional anomalous phase angles for that SSL fixture over the normal course of interaction between the dimmer and the SSL fixture. The skip-phase dimming module may provide users with the option to define a custom SSL fixture type in the event the particular SSL fixture being used is not included on the predefined list. The skip-phase dimming module may also include an optional learning mode in which it automatically steps through the available dimming levels for a given SSL fixture, determine whether any of the associated phase angles results in a visual anomaly, and stores that phase angle as an anomalous phase angle.

In some implementations, the dimmer may communicate remotely with smart phones, smart watches, tablets, and other mobile devices using the controller and the wireless module. Such mobile devices may include applications (apps) that allow users to control the dimmer to adjust room lighting remotely. Users may select predefined room profiles or set up custom room profiles for different rooms, and the dimmer automatically adjusts the lighting in the rooms according to the profiles. The profiles may be based on any suitable room criteria, including time of day, ambient light, occupancy, and the like. Where the dimmer includes a display, a graphical user interface may be provided on the display to allow users to control the dimmer and/or modify room profiles using icons and other graphical selection tools.

In general, in one aspect, the disclosed embodiments are directed to a dimmer for SSL fixtures. The dimmer comprises, among other things, a dimming circuit configured to provide an AC output voltage to the SSL fixtures, and a controller coupled to the dimming circuit and configured to derive a phase angle for the AC output voltage, the phase angle corresponding to a phase cut in the AC output voltage. The dimmer further comprises a dimming input connected to the controller and configured to receive a dimming control signal representing a dimming level for the SSL fixtures, the dimming control signal being used by the controller to derive the phase angle for the AC output voltage. A skip-phase dimming module operates in conjunction with the controller to determine whether the phase angle is an anomalous phase angle that causes a visual anomaly in the SSL fixtures, and to skip the phase angle if the phase angle is determined to be an anomalous phase angle.

In general, in another aspect, the disclosed embodiments are directed to a method of controlling dimming for SSL fixtures. The method comprises, among other things, receiving a dimming control signal representing a dimming level for the SSL fixtures, and deriving a phase angle for an AC output voltage to be provided to the SSL fixtures based on the dimming control signal, the phase angle reflecting a phase cut in the AC output voltage. The method further comprises determining whether the phase angle is an anomalous phase that causes a visual anomaly in the SSL fixtures, and skipping the phase angle if the phase angle is determined to be an anomalous phase angle that causes a visual anomaly in the SSL fixtures.

In general, in yet another aspect, the disclosed embodiments are directed to a dimmable SSL system. The system comprises, among other things, a plurality of SSL fixtures, and a dimmer connected to the plurality of SSL fixtures and configured to provide an AC output voltage to the SSL fixtures based on a dimming control signal representing a dimming level for the SSL fixtures. The dimmer is operable in a learning mode in which the dimmer applies a plurality of dimming levels to the SSL fixture, determines whether any dimming level results in a visual anomaly in the SSL fixture, and stores a phase angle associated with the dimming level resulting in the visual anomaly in a list of anomalous phase angles.

BRIEF DESCRIPTION OF THE DRAWINGS

The foregoing and other advantages of the disclosed embodiments will become apparent upon reading the following detailed description and upon reference to the drawings, wherein.

DETAILED DESCRIPTION OF THE DISCLOSED EMBODIMENTS

As an initial matter, it will be appreciated that the development of an actual, real commercial application incorporating aspects of the disclosed embodiments will require many implementation specific decisions to achieve the developer's ultimate goal for the commercial embodiment. Such implementation specific decisions may include, and likely are not limited to, compliance with system related, business related, government related and other constraints, which may vary by specific implementation, location and from time to time. While a developer's efforts might be complex and time consuming in an absolute sense, such efforts would nevertheless be a routine undertaking for those of skill in this art having the benefit of this disclosure.

It should also be understood that the embodiments disclosed and taught herein are susceptible to numerous and various modifications and alternative forms. Thus, the use of a singular term, such as, but not limited to, "a" and the like, is not intended as limiting of the number of items. Similarly, any relational terms, such as, but not limited to, "top," "bottom," "left," "right," "upper," "lower," "down," "up," "side," and the like, used in the written description are for clarity in specific reference to the drawings and are not intended to limit the scope of the invention.

Figure 1:
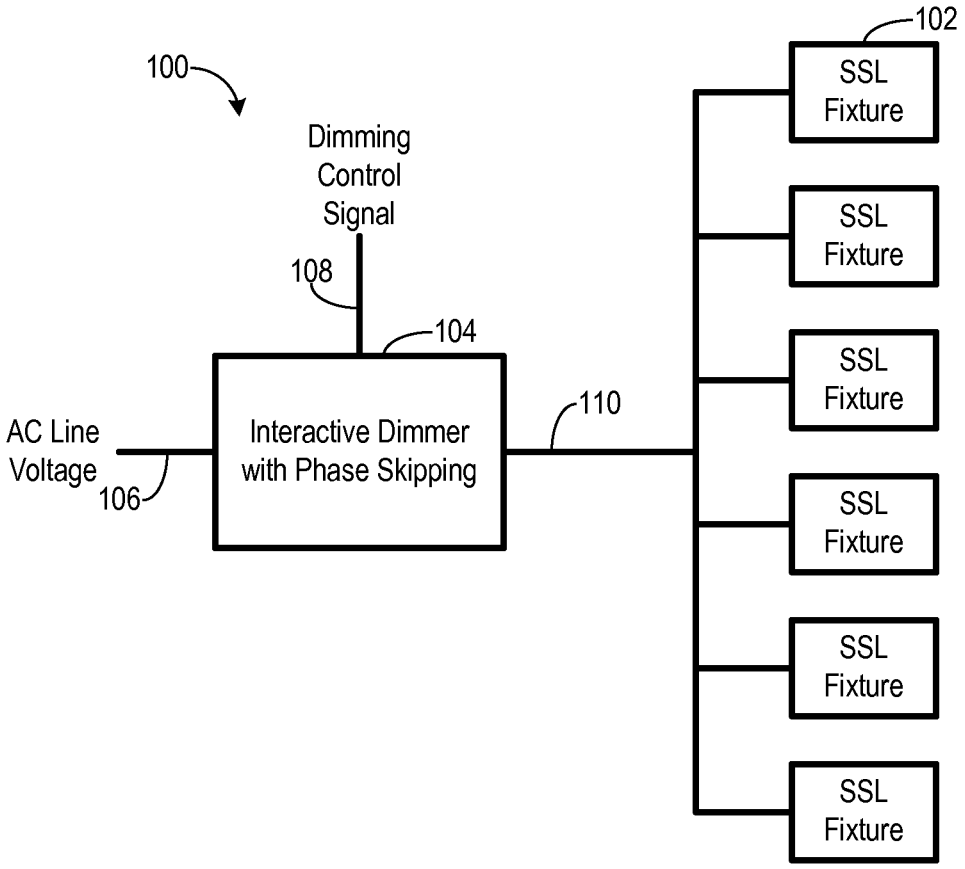
FIG. 1 illustrates an exemplary SSL lighting system with phase skipping functionality according to some implementations of the disclosed embodiments.

Referring now to FIG. 1, an exemplary solid-state lighting (SSL) lighting system 100 is shown in accordance with the disclosed embodiments. The lighting system 100 may be any SSL lighting system that uses LEDs or other SSL lighting, including indoor lighting systems, such as residential lights, office lights, retail store lights, restaurant lights, and the like, as well as outdoor lighting systems, such as street lights, parking lot lights, area lights, and the like.

As can be seen, the SSL lighting system 100 includes a plurality of SSL fixtures 102 connected to a dimmer 104 that is operable to control dimming of the SSL fixtures 102 as well as other, more conventional light fixtures (e.g., incandescent light fixtures). The dimmer 104 in the embodiment shown here is an interactive dimmer 104 in that a user may program, define, and otherwise control the operation of the dimmer, as explained later herein. The interactive dimmer 104 has, among other things, an AC input 106 that receives a AC line voltage, typically from an AC main, and a dimming input 108 that receives a dimming control signal, typically from a sliding switch, knob, dial, keypad, touchpad, and similar dimming input mechanisms. The dimming control signal is typically a voltage signal that represents or otherwise indicates a dimming level to be applied to the SSL fixtures 102. Users may operate the sliding switch, knob, dial, keypad, touchpad, and so forth to generate the dimming control signal, and the dimmer 104 adjusts the AC line voltage from the AC main based on the dimming control signal to generate a dimmed or otherwise adjusted AC output voltage. The dimmer 104 thereafter outputs the dimmed AC output voltage at an AC output 110 to the SSL fixtures 102 to achieve the desired level of dimming.

In accordance with the disclosed embodiments, the dimmer 104 may be an interactive dimmer 104 that has phase skipping capability. As mentioned above, SSL fixtures like the SSL fixtures 102 typically have a driver with a switch mode power supply that may cause visual anomalies such as flicker when used with certain types of phase cut dimmers. This has prompted the need to identify which dimmers are compatible with which SSL fixtures, and vice versa, on product literature and packaging. The interactive dimmer 104 overcomes the compatibility issue by identifying and skipping dimming levels that cause, or are known to cause, visual anomalies such as flicker in the SSL fixtures 102. The ability to identify and skip incompatible and less compatible dimming levels allows the interactive dimmer 104 to employ any number of known dimming techniques with the SSL fixtures 102, including forward phase cut dimming, reverse phase cut dimming, 1-10 V DC dimming, as well as adaptive phase dimming that can sense fixture load types and automatically adjust to provide the best performance.

Figure 2:
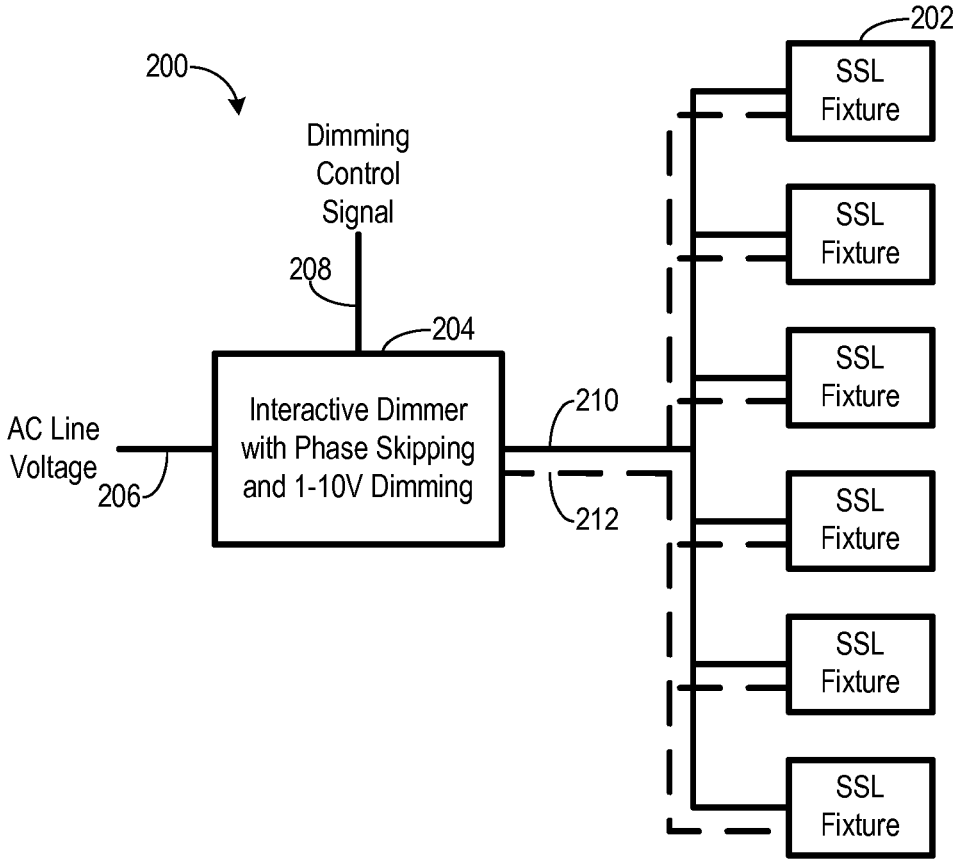
FIG. 2 illustrates an exemplary SSL lighting system with phase skipping and 1-10V dimming according to some implementations of the disclosed embodiments.

FIG. 2 illustrates another exemplary SSL lighting system 200 according to the disclosed embodiments in which 1-10 V DC dimming is used. The SSL lighting system 200 shown here is similar to the SSL lighting system 100 of FIG. 1 insofar as it includes a plurality of SSL fixtures 202 connected to an interactive dimmer 204 that can skip incompatible or less compatible phase angles. An AC input 206, a dimming input 208, and an AC output 210 are present on the interactive dimmer 204 and operate in a manner similar as their counterparts in FIG. 1. In addition, the interactive dimmer 204 may also include a DC output 212 that operates to provide a 1-10 V DC dimming signal to the SSL fixtures 202.

Figure 3:
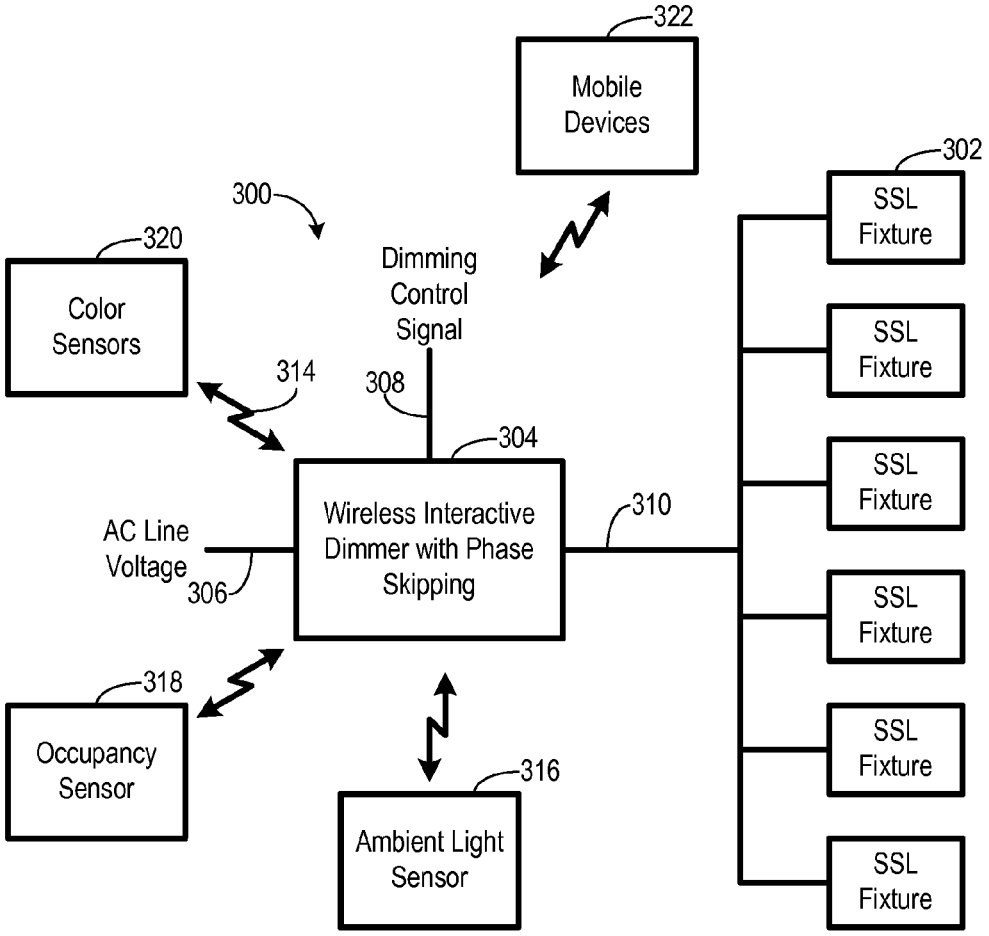
FIG. 3 illustrates an exemplary wireless SSL lighting system with phase skipping according to some implementations of the disclosed embodiments.

FIG. 3 shows an exemplary SSL lighting system 300 according to the disclosed embodiments in which dimming may be controlled remotely. The SSL lighting system 300 is similar to the SSL lighting system 100 of FIG. 1 to the extent it includes a plurality of SSL fixtures 302 connected to an interactive dimmer 304 that employs phase skipping capability. An AC input 306, a dimming input 308, and an AC output 310 are again present on the interactive dimmer 304 and operate in a similar manner as their counterparts in FIG. 1. Furthermore, the interactive dimmer 304 includes built-in wireless capability for establishing a wireless connection 314 with remote sensors and other remote input devices. These remote sensors and other input devices may include, for example, ambient light sensors 316, occupancy sensors 318, color sensors 320, and the like. Likewise, smart phones, smart watches, tablets, and other mobile devices 322 may also connect to the interactive dimmer 404 over the wireless connection 314 to provide control signals to the interactive dimmer 304. The interactive dimmer 304 may then use the control signals from the remote sensors and other input devices to generate an adjusted AC output voltage for the SSL fixtures 302.

Figure 4:
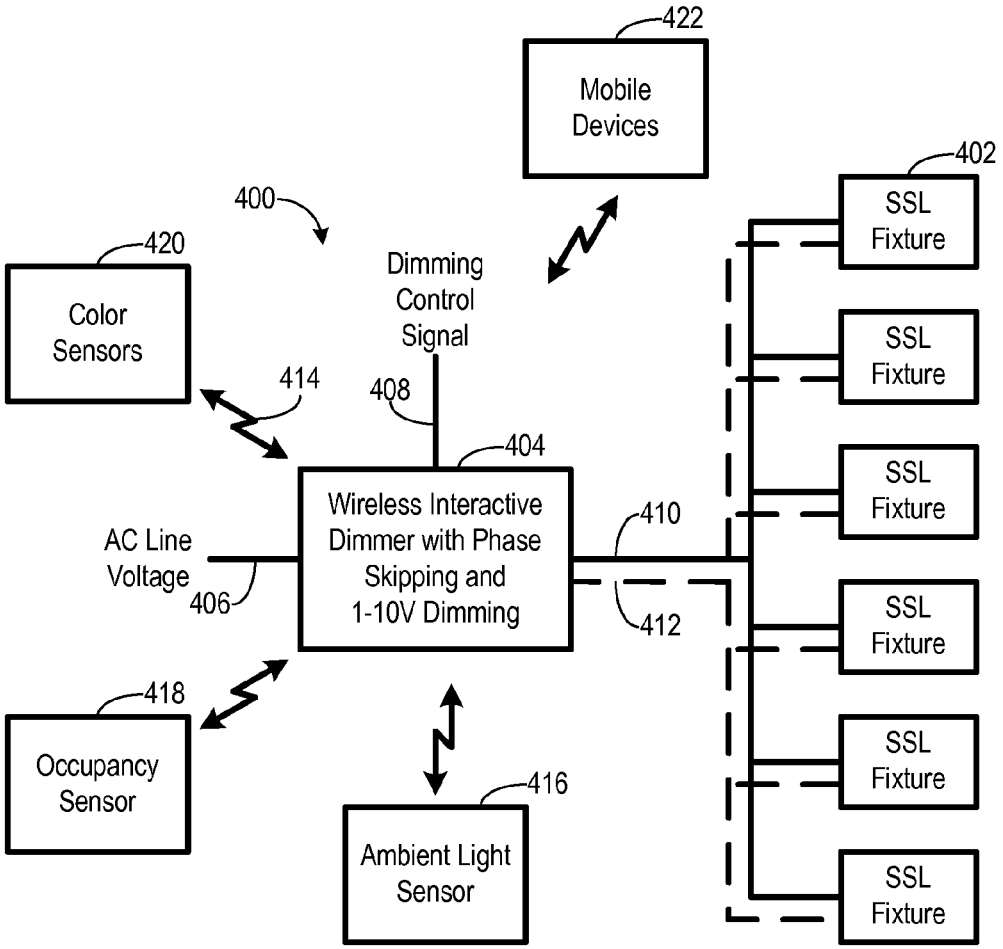
FIG. 4 illustrates an exemplary wireless SSL lighting system with phase skipping and 1-10V dimming according to some implementations of the disclosed embodiments.

FIG. 4 shows another exemplary SSL lighting system 400 according to the disclosed embodiments that includes wireless capability as well as 1-10 V dimming. The SSL lighting system 400 is similar to the SSL lighting system 300 of FIG. 3 in that it includes a plurality of SSL fixtures 402 connected to an interactive dimmer 404 that uses phase skipping. An AC input 406, a dimming input 408, and an AC output 410 are present on the interactive dimmer 404 and operate in a similar manner as their counterparts in FIG. 3. As well, a DC output 412 is present for providing a 1-10 V DC dimming signal to the SSL fixtures 402, and built-in wireless capability allows a wireless connection 414 to be established between the interactive dimmer 404 and remote ambient light sensors 416, occupancy sensors 418, color sensors 420, mobile devices 422, and the like.

Figure 5:
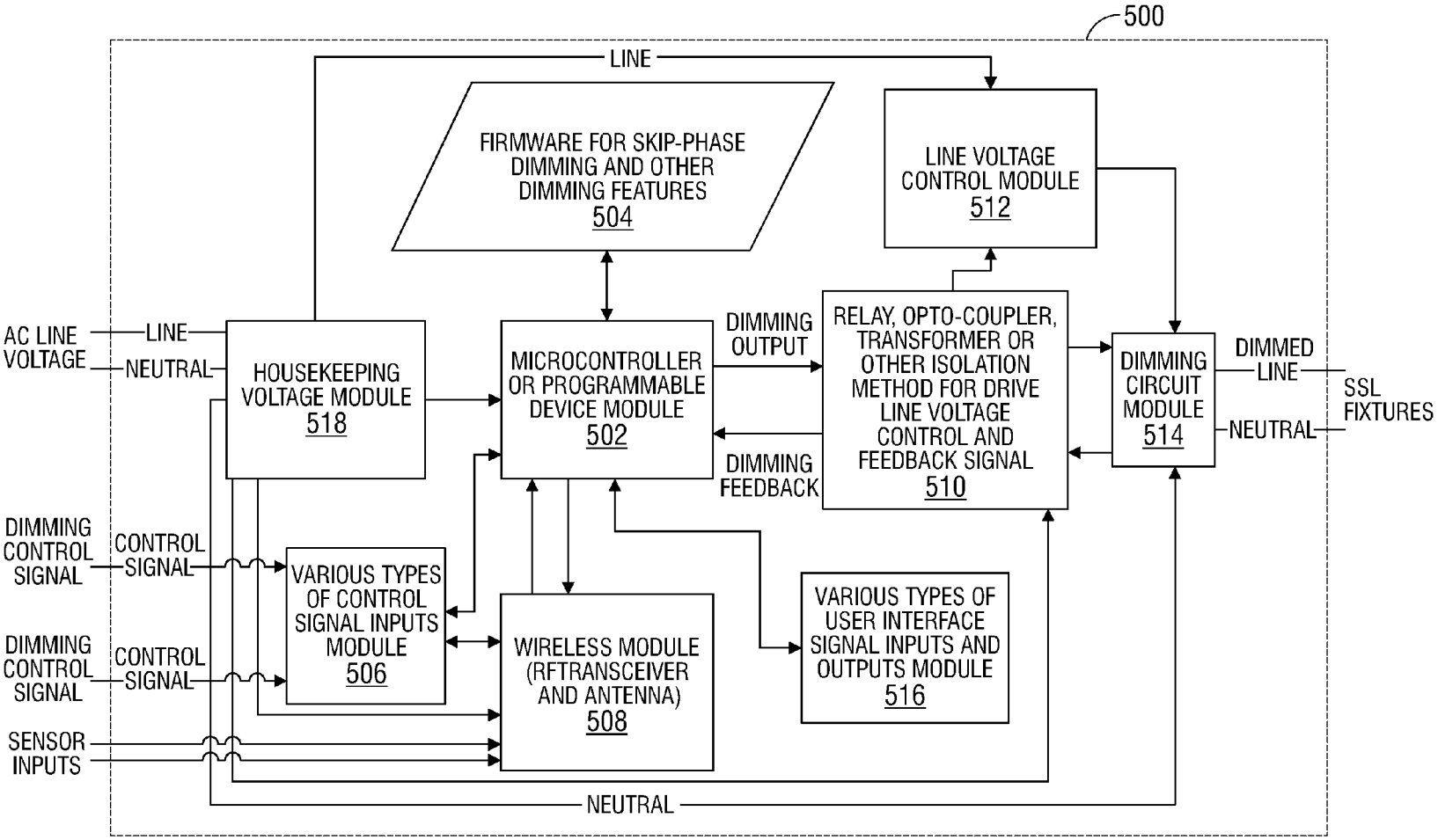
FIG. 5 illustrates an exemplary block diagram for a wireless interactive dimmer with phase skipping according to some implementations of the disclosed embodiments.

In the above SSL lighting systems, the presence of a dimmer that can skip or otherwise avoid or stop using incompatible or less compatible phase angles allows the SSL fixtures to be substantially free of flicker and other visual anomalies. Following now in FIG. 5 is an exemplary implementation of the dimmer, shown generally at 500. In FIG. 5, the dimmer 500 is depicted as being composed of a number of functional components or modules that are represented as discrete blocks. It should be understood that any individual block may be divided into two more constituent blocks, and that two or more blocks may be combined to form a single block, without departing from the scope of the exemplary disclosed embodiments. Also, although the various blocks may appear to be arranged in a particular sequence, it should be understood that one or more of the blocks may be taken outside the sequence shown, or omitted altogether in some cases, without departing from the scope of the exemplary disclosed embodiments.

As FIG. 5 shows, the main functional component in the dimmer 500 is a controller or similar programmable device or module 502. The controller 502 is primarily responsible for the overall operation of the dimmer 500, including execution of any programs or algorithms that may be needed to produce dimming in the SSL fixtures. Any suitable programmable device may be used for the controller 502, including a programmable logic device (PLD), field programmable gate array (FPGA), analog and analog mix mode circuitry, a microcontroller, and the like. Where the controller 502 is a microcontroller, a suitable microcontroller may include the PICO family of microcontrollers from Microchip Technology, Inc., and the like.

Also included in the dimmer 500 is a skip-phase dimming module 504 that functions to provide the phase skipping capability for the dimmer 500. The skip-phase dimming module 504 is responsible for detecting and keeping track of dimming levels that cause, or are known to cause, flicker in the SSL fixtures. This skip-phase dimming module 504 may reside in firmware or as software stored in the controller 502, or as a combination of both, and operates in conjunction with the controller 502 to detect and identify dimming levels that cause visual anomalies such as flicker in the SSL fixtures. Additional details regarding the operation of the skip-phase dimming module 504 in the dimmer 500 is provided later herein with respect to FIGS. 6-8.

The dimmer 500 also includes an inputs module 506 that functions to receive control signals, including dimming control signals, from various sources (e.g., switches, knob, dial, keypad, touchpad, etc.). The inputs module 506 operates to process (e.g., smooth, amplify, etc.) and provide these control signals to the controller 502. Likewise, a wireless module 508 receives wireless control signals, including dimming control signals and environmental control signals, from various sources (e.g., sensors, mobile devices, etc.). Any suitable wireless module having a radio frequency transceiver and antenna, including a Wi-Fi module, Bluetooth module, and the like, may be used for the wireless module 508 without departing from the scope of the disclosed embodiments.

Based on the dimming control signals and/or sensor signals from the inputs module 506 and the wireless module 508, the controller 502 generates a dimming output representing the level of dimming indicated by the control signals and/or sensor signals. The controller 502 thereafter provides the dimming output to an isolation device 510, which may be a relay, optical coupler, transformer, and the like. The isolation device 510 provides physical isolation for the controller 502, passing signals back and forth from downstream components to the controller 502 while protecting the controller 502 from, for example, any unexpected feedback.

In the embodiment shown here, the isolation device 510 passes the dimming output from the controller 502 to a line voltage control module 512 and a dimming circuit module 514 in the dimmer 500. The line voltage control module 512 uses the dimming output from the controller 502 to generate an appropriate AC output voltage from the AC line voltage, then provides the AC output voltage to the dimming circuit module 514. The dimming circuit module 514 uses the AC output voltage from the line voltage control module 512 and the dimming output from the controller 502 to generate a dimmed AC output voltage, then provides the dimmed AC output voltage to the SSL fixtures.

In some embodiments, the dimming circuit module 514 may generate the dimmed AC output voltage by adjusting an RMS value of the AC output voltage from the line voltage control module 512, for example, using either forward phase cut dimming or reverse phase current dimming. The specific phase cuts applied by the dimming circuit module 514 to generate the dimmed AC output voltage may be specified by, or otherwise included in, the dimming output from the controller 502. The controller 502 may derive these specific phase cuts using any suitable technique known to those having ordinary skill in the art based on the dimming control signals and/or sensor signals received by the controller 502. These phase cuts, or rather the phase angles corresponding to the phase cuts, are also provided by the controller 502 to the skip-phase dimming module 504.

In some embodiments, the skip-phase dimming module 504 identifies anomalous phase angles by monitoring a feedback from the SSL fixtures for anomalies such as ripples or fluctuations that are larger than a preset anomaly threshold. In the embodiment shown here, the feedback from the SSL fixtures is provided over an existing neutral line that is already present between the SSL fixtures and the dimming circuit module 514. Any anomalies such as ripples or fluctuations on the neutral line are then passed by the dimming circuit module 514 to the controller 502 via the isolation device 510. In other embodiments, a separate and dedicated feedback line (not expressly shown) may be provided from the SSL fixtures to the controller 502 instead (via the isolation device 510).

In some embodiments, a user interface module 516 is provided in the dimmer 500 for receiving various types of user interface signal inputs and providing them to the controller 502. Such user interface signal inputs may include, for example keyboard inputs, touchpad inputs, and other types of signal inputs that allow a user to program, define, or otherwise control the operation of the dimmer 500. Finally, a housekeeping voltage module 518 in the dimmer 500 receives the AC line voltage and converts it to one or more regulated DC voltages (e.g., 5.0 V, 3.3 V, 1.8 V, etc.) needed by the controller 502 and other modules in the dimmer 500 to properly operate.

Figure 6:
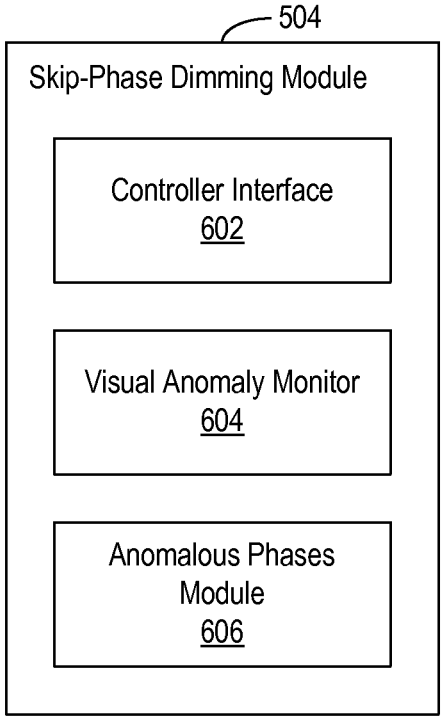
FIG. 6 illustrates an exemplary block diagram for a skip-phase dimming module for a dimmer according to some implementations of the disclosed embodiments.

FIG. 6 illustrates an exemplary implementation of the skip-phase dimming module 504 in accordance with the disclosed embodiments. As can be seen, the exemplary skip-phase dimming module 504 may be composed of several functional components, including a controller interface 602, a flicker monitor 604, and an anomalous phases module 606. These components operate in conjunction with the controller 502 to provide the dimmer 500 the ability automatically to skip or otherwise avoid further using anomalous phase angles. This ability to avoid anomalous phase angles allows the dimmer 500 to be compatible with virtually any SSL fixture from any manufacturer. It should also be noted, of course, that the dimmer 500 may be used with conventional incandescent fixtures without departing from the scope of the disclosed embodiments. Following is an explanation of how the various components of the skip-phase dimming module 504 may operate in some embodiments.

In general, the controller interface 602 facilitates communication between the skip-phase dimming module 504 and the controller 502. Thus, for example, the controller interface 602 allows the controller 502 to provide the skip-phase dimming module 504 with the phase angles corresponding to the phase cuts derived as mentioned above. The controller interface 602 also allows the controller 502 to provide the skip-phase dimming module 504 with the anomalies (e.g., ripples or fluctuations) from the SSL fixtures. These anomalies are received by the controller 502 (via the neutral line) and processed to determine, for example, an RMS value, a peak-to-peak value, or some other quantification of the anomalies. The controller 502 then communicates the RMS value, peak-to-peak value, or other information about the anomalies to the skip-phase dimming module 504 via the controller interface 602.

The visual anomaly monitor 604 operates mainly to detect visual anomalies such as flicker in the SSL fixtures. In some embodiments, the visual anomaly monitor 604 performs this detection by comparing the anomaly information received from the controller 502 to a preset anomaly threshold. Thus, the visual anomaly monitor 604 may include, store, or otherwise have access to a previously defined RMS threshold, peak-to-peak threshold, or other threshold information. This predefined threshold information may then be used to compare the information about the anomalies received from the controller 502. If the visual anomaly monitor 604 determines that the anomalies exceed the preset anomaly threshold, then it notifies the controller 502 (via the controller interface 602) that the phase angle provided by the controller 502 is an anomalous phase angle that is incompatible with the SSL fixtures being used. Upon receiving such notification, the controller 502 skips or stops further using the incompatible phase angle and proceeds to the next lower or higher incremental phase angle, whichever is nearest to the incompatible phase cut, or depending on whether dimming is being increased or decreased.

The visual anomaly monitor 604 also sends the identified anomalous phase angle to the anomalous phases module 606 for addition to a list or table of phase angles that have been identified as anomalous phase angles. The module 606 is primarily responsible for maintaining this list or table of anomalous phase angles up to date by adding new anomalous phase angles substantially in real time or dynamically whenever they are identified by the visual anomaly monitor 604. In this way, the skip-phase dimming module 504 is able automatically to learn and accumulate anomalous phase angles for any SSL fixture over time. In some embodiments, the list or table of anomalous phase angles may also include known anomalous phase angles that were inputted previously at the time of manufacture, for example, based on lab tests, in addition to any anomalous phase angles that may be added afterward. As well, the list or table of anomalous phase angles may be used by the visual anomaly monitor 604 to check any phase angles provided by the controller 502 (via the controller interface 602). If any phase angle provided by the controller 502 matches an identified anomalous phase angle, the visual anomaly monitor 604 notifies the controller 502 accordingly to skip or otherwise stop further using that incompatible phase angle.

In some embodiments, the skip-phase dimming module 504 may also include a learning mode that may be automatically engaged when the dimmer 500 is activated and/or manually engaged by the user as needed. When this learning mode is engaged for a given SSL fixture, the skip-phase dimming module 504 automatically applies each incremental dimming level to the SSL fixture, determines whether any dimming level results in a visual anomaly such as flicker in the SSL fixture, and records the phase angle associated with that dimming level as an anomalous phase angle via the anomalous phases module 606.

Table 1 below illustrates a conceptual anomalous phase angles table that may be used with the anomalous phases module 606. The table includes incompatibility information on various types of SSL fixtures sorted, for example, by manufacturer and model, along with identified or known anomalous phase angles for each fixture type. As can be seen, the identified or known anomalous phase angles may vary between manufacturer and/or model, although it is certainly possible for different models to have the same anomalous phase angles. The information in Table 1 may then be provided with or otherwise incorporated into the anomalous phases module 606, for example, during manufacture of the dimmer 500. When a user installs the dimmer 500, he or she may specify the specific SSL fixtures being used with the dimmer, and the anomalous phases module 606 thereafter automatically adds any additional anomalous phase angles to the table under the specified SSL fixtures. The anomalous phases module 606 may also provide users with an option to define a custom SSL fixture type in the event the particular SSL fixture being used is not included on the table.

TABLE 1

| Manufacturers | Models | Incompatible Phase Angles |
|---|---|---|
| Company A | Model U | Phase 1, Phase 3, Phase 5 . . . |
| | Model V | Phase 2, Phase 4, Phase 6 . . . |
| Company B | Model W | Phase 1, Phase 2, Phase 3 . . . |
| | Model X | Phase 4, Phase 5, Phase 6 . . . |
| Company C | Model Y | Phase 1, Phase 2, Phase 5 . . . |
| | Model Z | Phase 3, Phase 4, Phase 6 . . . |

Based on the foregoing description, it can be seen that the embodiments disclosed herein may be implemented in a number of ways. As one example, rather than listing incompatible phase angles in Table 1, the table may list incompatible DC voltages instead for dimmers that use 1-10 V DC dimming Various other ways of implementing dimming levels besides using phase cuts and DC voltages may also be employed without departing from the scope of the disclosed embodiments. Accordingly, following in FIG. 7 are general guidelines in the form of a flow chart 700 that may be used with any implementation of the disclosed embodiments.

Figure 7:
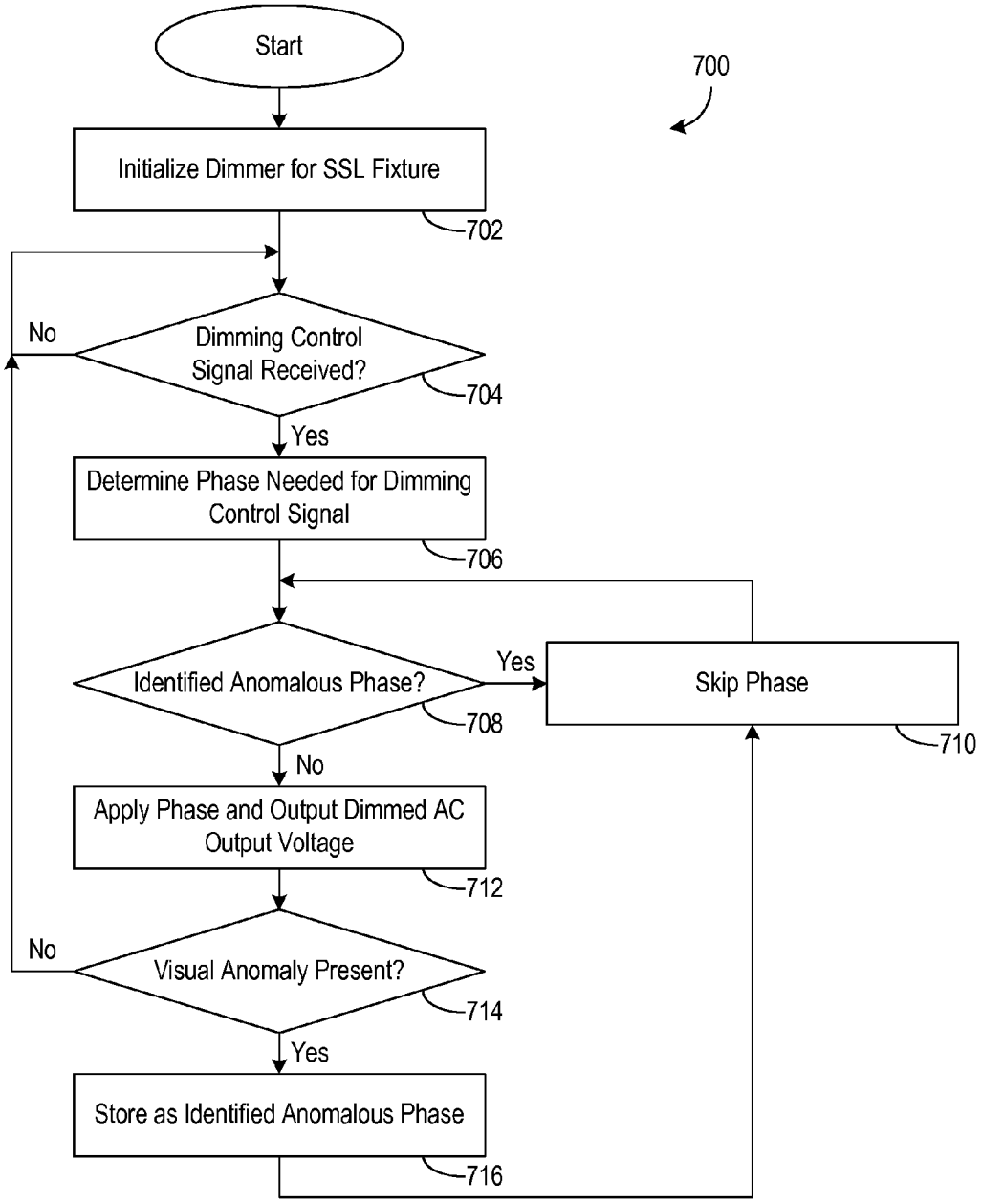
FIG. 7 illustrates an exemplary flowchart for a skip-phase dimming module for a dimmer according to some implementations of the disclosed embodiments.

As FIG. 7 shows, the flow chart 700 begins with the dimmer performing an internal initialization process at block 702, including retrieving the particular type of SSL fixtures being used with the dimmer, as specified by a user. At block 704, the dimmer makes a determination as to whether a dimming control signal has been received, for example, from a sliding switch, knob, dial, keypad, touchpad, and similar dimming input mechanisms, or from a sensor or mobile device over a wireless connection. Once the dimmer determines that a dimming control signal has been received, it proceeds at block 706 to derive or otherwise determine an appropriate phase cut, and corresponding phase angle, based on the dimmer control signal.

At block 708, the dimmer makes another determination as to whether the derived phase angle has been previously identified as an anomalous phase angle. If yes, the dimmer skips that phase angle at block 710 and proceeds to the next incremental phase angle, and the process is repeated until an anomaly-free phase angle (i.e., a phase angle that has not been identified as an anomalous phase angle) is reached. Thereafter, the dimmer uses the anomaly-free phase angle, or more accurately, the phase cut corresponding to the anomaly-free phase angle, to generate and output a dimmed AC output voltage to the SSL fixtures at block 712.

At block 714, the dimmer makes a further determination as to whether the phase angle from block 712 causes flicker or other visual anomalies in the SSL fixtures. In some embodiments, the dimmer performs this determination by monitoring the feedback from the SSL fixtures for anomalies such as ripples or fluctuations that exceed a preset threshold. If a visual anomaly such as flicker is detected, then at block 716, the dimmer stores the phase angle from block 712 as an identified anomalous phase angle and skips to the next anomaly-free phase angle at block 710. If no anomaly is detected in the SSL fixtures, then the dimmer returns to block 704 to await another dimming control signal.

Figure 8A:
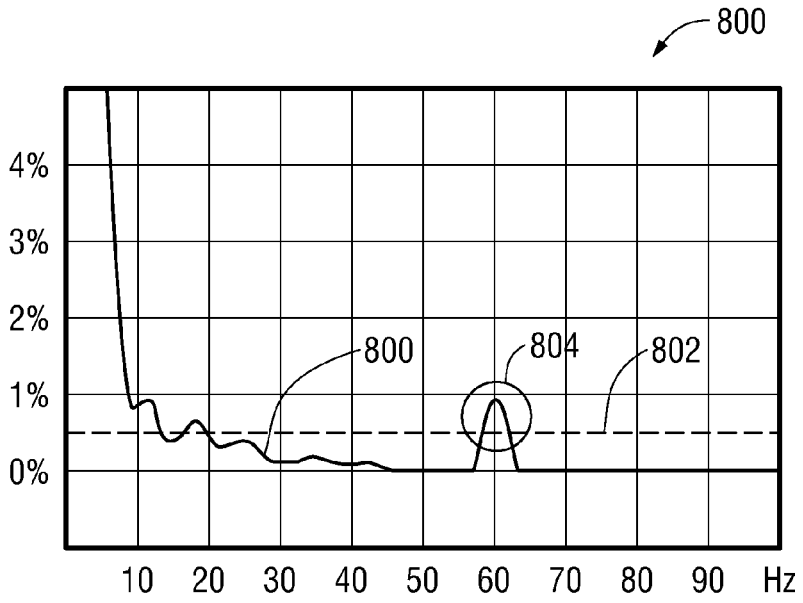
FIGS. 8A and 8B illustrate examples of ripples and a preset threshold for a dimmer according to some implementations of the disclosed embodiment.
Figure 8B:
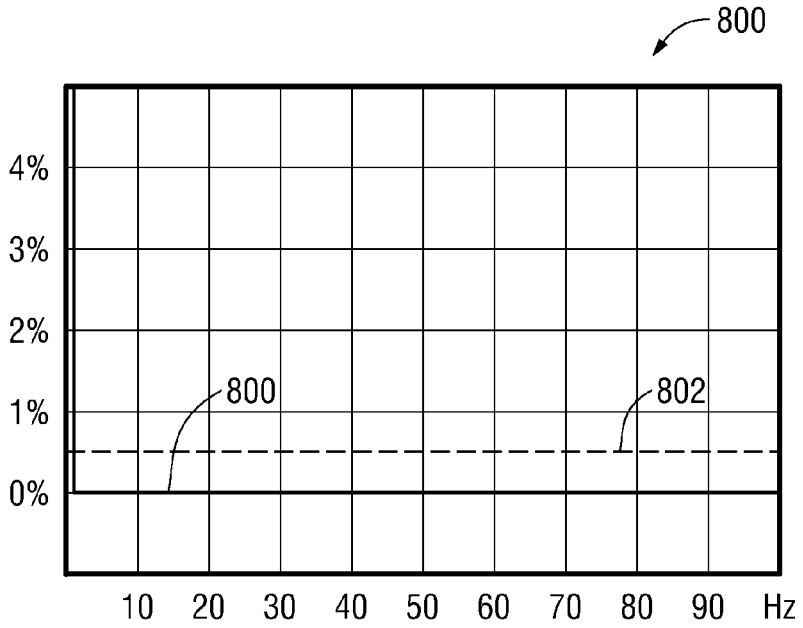

An exemplary anomaly detection technique that may be used by the dimmer to identify anomalous phase angles is graphically illustrated in FIGS. 8A and 8B in the form of a feedback graph 800 from the SSL fixtures. In this example, the horizontal axis represents frequency and the vertical axis represents the amplitude of the visual anomaly as a percentage.

In the example of FIG. 8A, the particular dimming control signal received by the dimmer has resulted in the SSL fixtures receiving a dimmed AC output signal with a phase-cut period of 4.68 ms. This phase-cut period translates to a corresponding phase angle of 78.5° ((8.3 ms-4.68 ms)/8.3 ms*180°=78.5°, where 8.3 ms is the cycle time for a standard 120 Hz AC line voltage). An anomaly threshold has been set at 0.5%, as indicated by the dashed line 802. Thus, if the feedback graph 800 has any anomalies such as ripples in the, say, 10 Hz to 90 Hz range that exceed the preset anomaly threshold 802, then a visual anomaly is considered to be present in the SSL fixtures, and the phase angle corresponding to the phase cut is identified as an anomalous phase angle. As can be seen here, there are ripples in the feedback graph 800 at least in the 60 Hz area, indicated at 804, that is higher than the preset anomaly threshold 802. Accordingly, the phase angle)(78.5° corresponding to this phase cut (4.68 ms) is identified as an anomalous phase angle and subsequently skipped in the manner described above.

FIG. 8B, on the other hand, shows no anomalies in the feedback graph 800 between the 10 Hz to 90 Hz range that exceed the preset anomaly threshold 802. In this example, the SSL fixtures are receiving a dimmed AC output signal having a phase-cut period of 4.96 ms, which translates to a phase angle of 72.4° ((8.3 ms−4.96 ms)/8.3 ms*180°=72.4°). As no anomalies in the relevant frequency range of the feedback graph 800 exceeds the preset anomaly threshold 802, no visual anomaly is considered to be present, and the phase angle)(72.4° corresponding to this phase cut (4.96 ms) is not skipped.

Figure 9A:
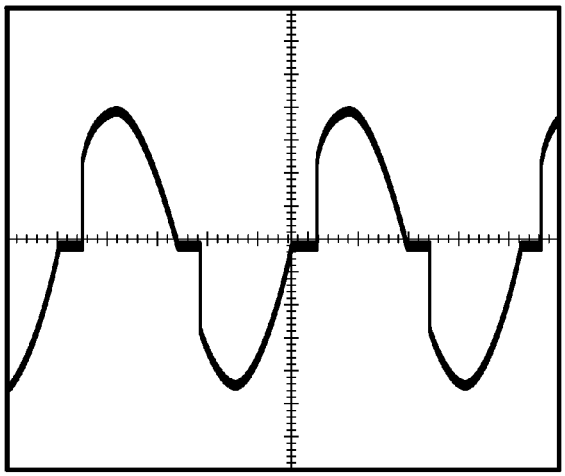
FIGS. 9A-9E illustrate examples of phase cut voltage waveforms that may result in phase skipping according to some implementations of the disclosed embodiment.
Figure 9B:
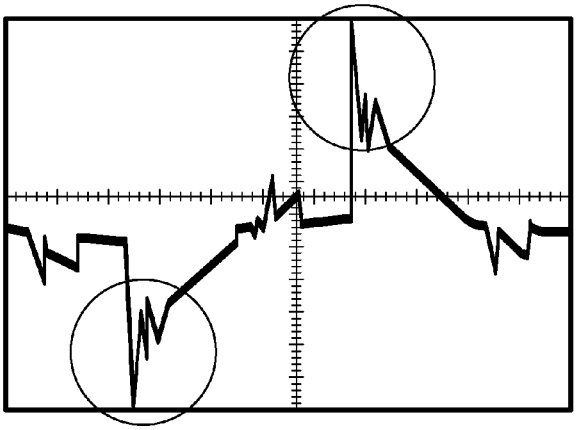
Figure 9C:
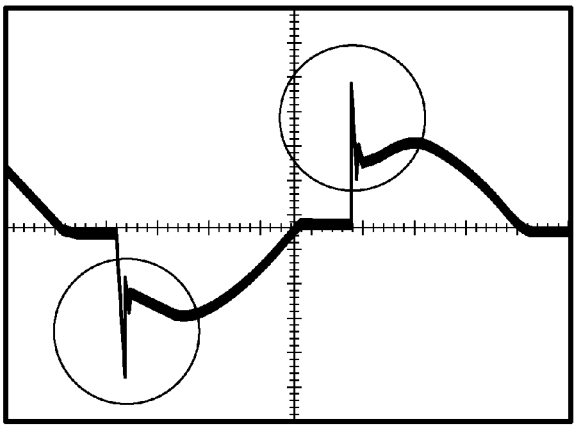
Figure 9D:
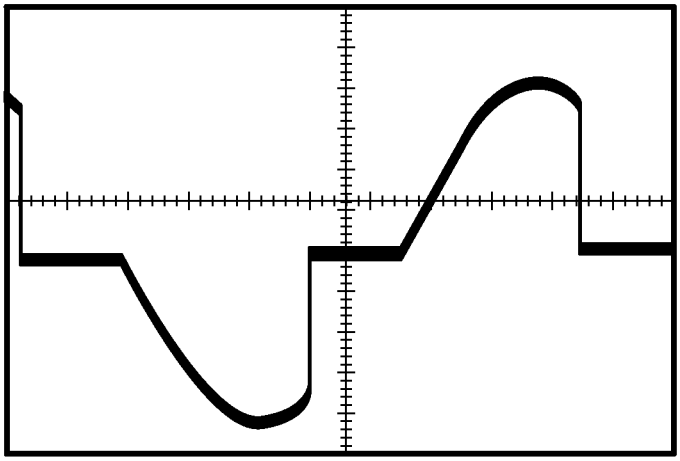
Figure 9E:
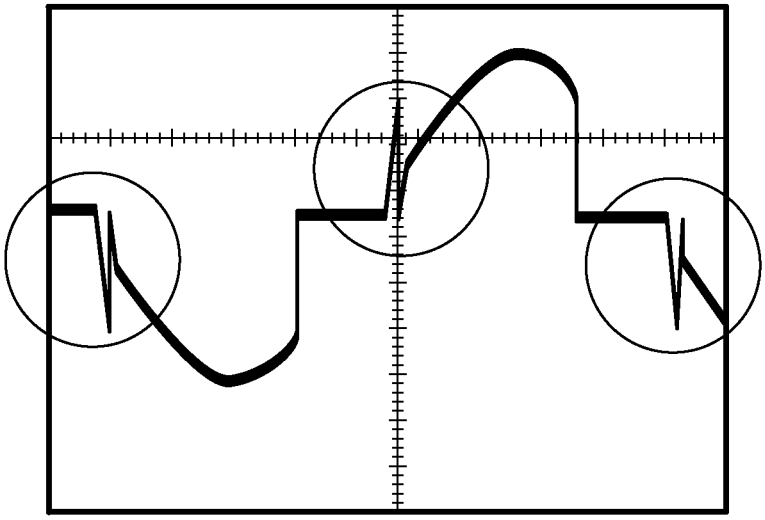

For reference purposes, FIGS. 9A-9E show several examples of phase-cut voltage waveforms that may be experienced by the SSL fixtures. Referring first to FIG. 9A, an example of a relatively clean forward phase cut voltage waveform is shown that would not produce any visual anomalies such as flicker in the SSL fixtures. FIGS. 9B and 9C show examples of forward phase cut voltage waveforms that have been distorted due to an incompatibility between the dimmer and the SSL fixtures. These distortions (circled area) would cause visual anomalies such as flicker in the SSL fixtures and would therefore be skipped by the skip-phase dimming module disclosed herein. Similarly, FIG. 9D shows an example of a relatively clean reverse phase cut voltage waveform that would not cause visual anomalies such as flicker, while FIG. 9E shows an example of a reverse phase cut voltage waveform that has been distorted because of an incompatibility between the dimmer and the SSL fixtures and would therefore be skipped.

While much of the discussion thus far has involved dimming control signals generated via sliding switches, knobs, dials, keypads, touchpads, and similar dimming input mechanisms, in some embodiments, the dimming control signals may also come from mobile devices, such as smart phones, smart watches, tablets, and the like. In these embodiments, the dimmer is an interactive dimmer and the mobile devices may communicate remotely with the dimmer over a wireless connection using environmental control applications (apps) on the mobile devices. These environmental control apps allow users to adjust room lighting from a remote location by controlling the dimmer remotely. Examples of environmental control apps are shown in FIGS. 10 and 11.

Figure 10:
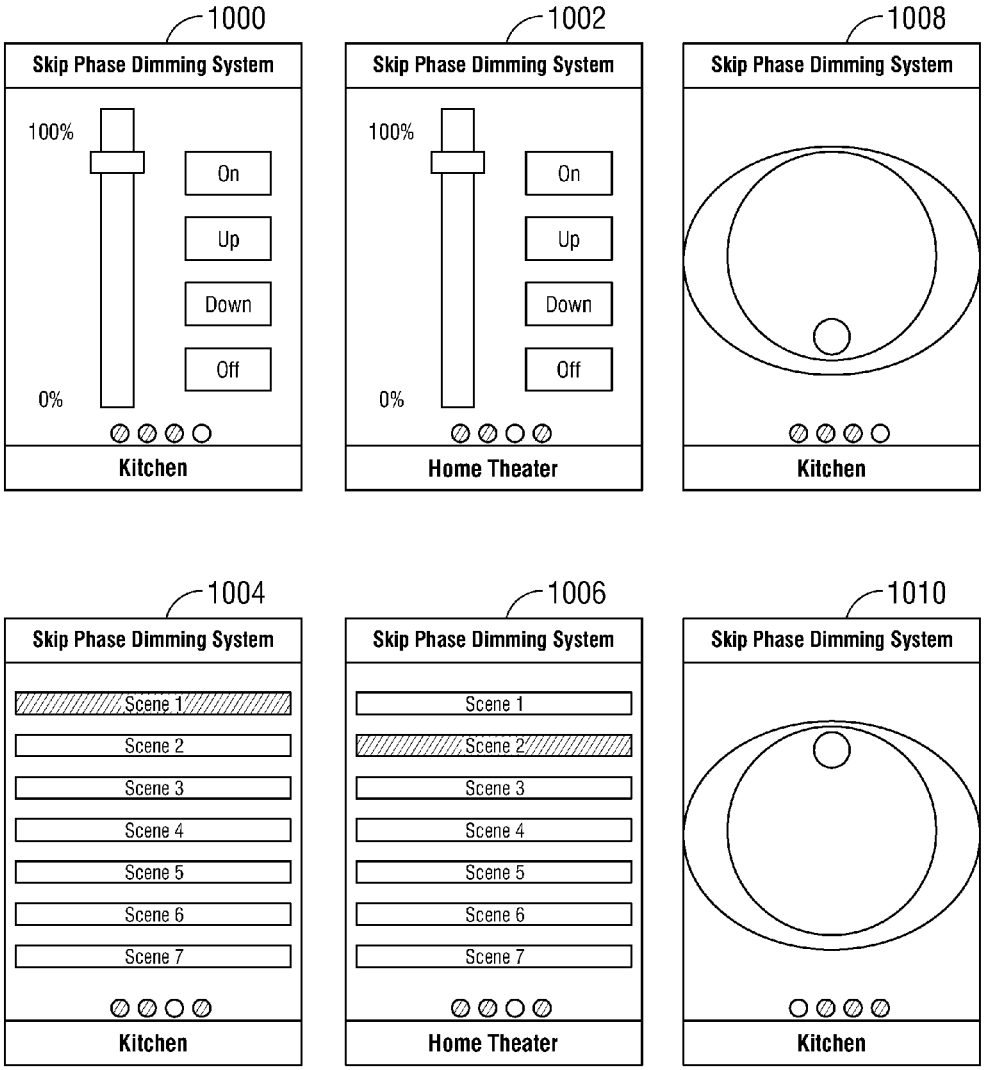
FIG. 10 illustrates exemplary smart phone apps for a dimmer according to some implementations of the disclosed embodiments.

In FIG. 10, there are six screenshots showing examples of smart phone environmental control apps that allow room lighting to be adjusted remotely by controlling the interactive dimmer remotely. The first two screenshots, indicated 1000 and 1002, allow room lighting for a home theater environment to be remotely controlled, including remote control of sconces and blackouts. The third and fourth screenshots, indicated at 1004 and 1006, allow room lighting to be controlled for a kitchen environment. And the last two screenshots, indicated at 1008 and 1010, are alternative screenshots for controlling a kitchen environment.

Figure 11:
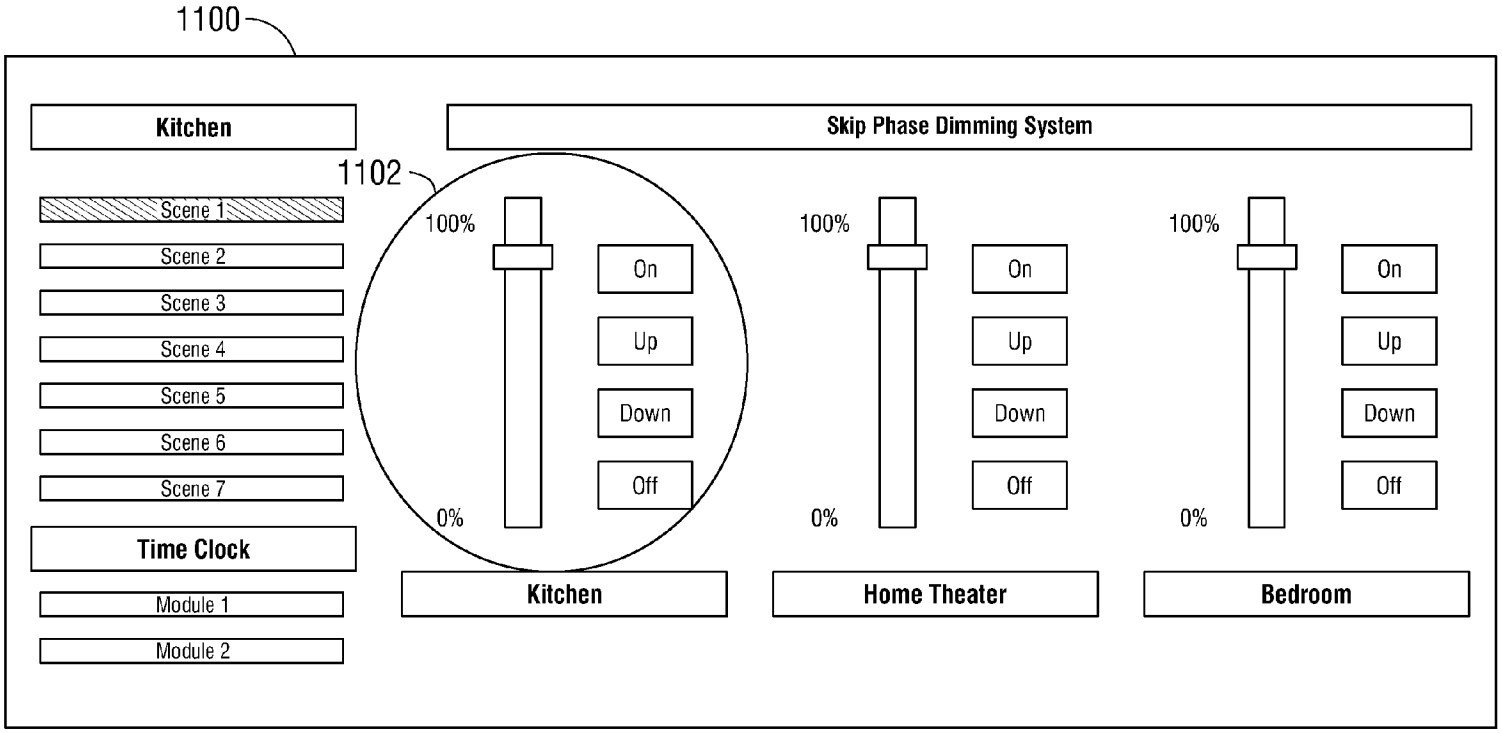
FIG. 11 illustrates an exemplary tablet app for a dimmer according to some implementations of the disclosed embodiments.

FIG. 11 shows a screenshot 1100 of an exemplary environmental control app for a tablet device. This exemplary environmental control app allows a user to adjust not only room lighting via the interactive dimmer, as indicated generally at 1102, but also window shades via a shade controller, room temperature via a thermostat, and the like.

Figure 12:
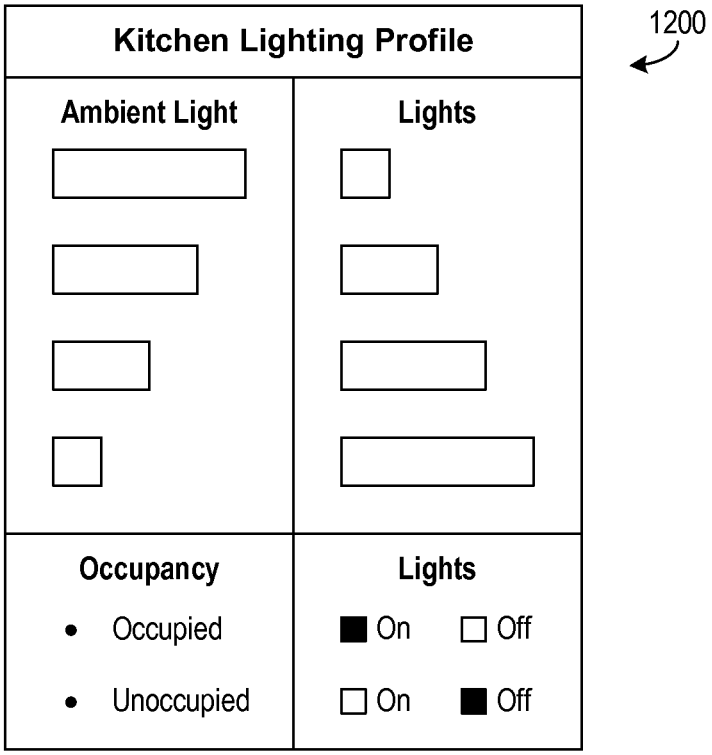
FIG. 12 illustrates an exemplary room lighting profile for a dimmer according to some implementations of the disclosed embodiments.

In some embodiments, users may also use their mobile devices to set up custom room lighting profiles for different rooms or select one of several predefined room lighting profiles. The dimmer then automatically adjusts the lighting in these rooms according to the profiles. FIG. 12 shows an exemplary room lighting profile 1200 for a kitchen that may be used in some embodiments. According to this kitchen lighting profile 1200, when the ambient light is high (e.g., as indicated by light sensors), the dimmer automatically dims the lights to a low level, whereas when the ambient light is low, the dimmer automatically adjusts the lights to a non-dimmed level. Similarly, when the kitchen is occupied (e.g., as indicated by motion sensors), the dimmer automatically turns on the lights, and when the kitchen is empty, the dimmer automatically turns off the lights. Many other room lighting criteria may be used instead of or in addition to ambient light and occupancy without departing from the scope of the disclosed embodiments, including time of day, day of the week, and the like.

Finally, although not expressly shown, in embodiments where the dimmer includes a display unit, a graphical user interface similar to the screenshots shown in FIGS. 10 and 11 may be provided on the display unit to allow users to control the dimmer and/or define and modify room profiles using icons and other graphical selection tools.

While particular aspects, implementations, and applications of the present disclosure have been illustrated and described, it is to be understood that the present disclosure is not limited to the precise construction and compositions disclosed herein and that various modifications, changes, and variations may be apparent from the foregoing descriptions without departing from the spirit and scope of the disclosed embodiments as defined in the appended claims.

What is claimed is:

1. A dimmer for solid-state lighting (SSL) fixtures, comprising:

a dimming circuit configured to provide an AC output voltage to the SSL fixtures;

a controller coupled to the dimming circuit and configured to derive a phase angle for the AC output voltage, the phase angle corresponding to a phase cut in the AC output voltage;

a dimming input connected to the controller and configured to receive a dimming control signal representing a dimming level for the SSL fixtures, the dimming control signal being used by the controller to derive the phase angle for the AC output voltage; and a skip-phase dimming module operable in conjunction with the controller to determine whether the phase angle is an anomalous phase angle that causes a visual anomaly in the SSL fixtures, and to skip the phase angle if the phase angle is determined to be an anomalous phase angle.

2. The dimmer of claim 1, wherein the controller is one of: a microcontroller, a programmable logic device (PLD), a field programmable gate array (FPGA), analog circuitry, and analog mixed mode circuitry.

3. The dimmer of claim 1, wherein the skip-phase dimming module is operable in conjunction with the controller to determine whether the phase angle is an anomalous phase angle that causes a visual anomaly in the SSL fixtures by comparing the phase angle to a list of identified phase angles that cause visual anomalies in the SSL fixtures.

4. The dimmer of claim 3, wherein the skip-phase dimming module is further operable in conjunction with the controller to skip the phase angle by substituting the phase angle with a next or previous phase angle that is not on the list of identified phase angles that cause visual anomalies in the SSL fixtures.

5. The dimmer of claim 4, wherein the list of identified phase angles that cause visual anomalies in the SSL fixtures varies according to a manufacturer and/or a model of the SSL fixtures.

6. The dimmer of claim 1, wherein the skip-phase dimming module is operable in conjunction with the controller to determine whether the phase angle is an anomalous phase angle that causes a visual anomaly in the SSL fixtures by detecting anomalies on a feedback signal from the SSL fixtures.

7. The dimmer of claim 6, wherein the skip-phase dimming module is further operable in conjunction with the controller to determine whether the phase angle is an anomalous phase angle that causes a visual anomaly in the SSL fixtures by comparing the anomalies to a preset threshold.

8. The dimmer of claim 6, wherein the skip-phase dimming module is further operable in conjunction with the controller to add the phase to a list of identified flicker phases if the phase is determined to be a flicker phase.

9. A method of controlling dimming for solid-state lighting (SSL) fixtures, comprising:

receiving a dimming control signal representing a dimming level for the SSL fixtures;

deriving a phase angle for an AC output voltage to be provided to the SSL fixtures based on the dimming control signal, the phase angle reflecting a phase cut in the AC output voltage;

determining whether the phase angle is an anomalous phase that causes a visual anomaly in the SSL fixtures; and skipping the phase angle if the phase angle is determined to be an anomalous phase angle that causes a visual anomaly in the SSL fixtures.

10. The method of claim 9, wherein determining whether the phase angle is a flicker phase comprises comparing the phase angle to a list of identified phase angles that cause visual anomalies in the SSL fixtures.

11. The method of claim 10, wherein skipping the phase angle comprises substituting the phase angle with a next or previous phase angle that is not on the list of identified phase angles that cause visual anomalies in the SSL fixtures.

12. The method of claim 10, wherein the list of identified phase angles that cause visual anomalies in the SSL fixtures varies according to a manufacturer and/or a model of the SSL fixtures.

13. The method of claim 9, wherein determining whether the phase angle is an anomalous phase angle that causes a visual anomaly in the SSL fixtures comprises detecting anomalies on a feedback signal from the SSL fixtures.

14. The method of claim 13, wherein determining whether the phase angle is an anomalous phase angle that causes a visual anomaly in the SSL fixtures further comprises comparing the anomalies to a preset threshold.

15. The method of claim 13, further comprising adding the phase angle to a list of identified phase angles that cause visual anomalies in the SSL fixtures if the phase angle is determined to be an anomalous phase angle that causes a visual anomaly in the SSL fixtures.

16. A dimmable solid-state lighting (SSL) system, comprising:

a plurality of SSL fixtures; and a dimmer connected to the plurality of SSL fixtures and configured to provide an AC output voltage to the SSL fixtures based on a dimming control signal representing a dimming level for the SSL fixtures;

wherein the dimmer is operable in a learning mode in which the dimmer applies a plurality of dimming levels to the SSL fixture, determines whether any dimming level results in a visual anomaly in the SSL fixture, and stores a phase angle associated with the dimming level resulting in the visual anomaly in a list of anomalous phase angles.

17. The dimmable SSL system of claim 16, further comprising a wireless module embedded in the dimmer and configured to receive the dimming control signal for the dimmer.

18. The dimmable SSL system of claim 16, wherein the dimming control signal is received by the wireless module from one of a plurality of remote sensors, the plurality of remote sensors including an occupancy sensor, an ambient light sensor, and a color sensor.

19. The dimmable SSL system of claim 16, wherein the dimming control signal is received by the wireless module from a smart device.

20. The dimmable SSL system of claim 19, wherein the smart device includes room profiles for the dimmer, each room profile having predefined room criteria for adjusting the dimming level of the SSL fixtures, the predefined room criteria including time of day, level of ambient light, and room occupancy.

21. The dimmable SSL system of claim 16, wherein the dimmer includes a graphical user interface for allowing users to manually control the dimmer.

22. The dimmable SSL system of claim 21, wherein the graphical user interface allows the user to set room profiles for the dimmer, each room profile having predefined room criteria for adjusting the dimming level of the SSL fixtures, the predefined room criteria including time of day, level of ambient light, and room occupancy.

* * * * *